US008938987B2

(12) United States Patent
Schroeder et al.

(10) Patent No.: US 8,938,987 B2
(45) Date of Patent: Jan. 27, 2015

(54) TABLE TOP WATER DISPENSER HAVING A REFRIGERATOR-COOLED COLD PLATE

(75) Inventors: A. A. "Jud" Schroeder, San Antonio, TX (US); William Edwards, Selma, TX (US)

(73) Assignee: Schroeder Industries, Inc., San Antonio, TX (US)

( * ) Notice: Subject to any disclaimer, the term of this patent is extended or adjusted under 35 U.S.C. 154(b) by 570 days.

(21) Appl. No.: 13/234,789

(22) Filed: Sep. 16, 2011

(65) Prior Publication Data

US 2012/0067076 A1 Mar. 22, 2012

Related U.S. Application Data

(60) Provisional application No. 61/383,462, filed on Sep. 16, 2010.

(51) Int. Cl.
*B67D 5/56* (2006.01)
*B67D 1/00* (2006.01)
(Continued)

(52) U.S. Cl.
CPC ..... *B67D 1/0003* (2013.01); *B67D 1/0057* (2013.01); *B67D 1/06* (2013.01); *B67D 1/0862* (2013.01); *B67D 1/0884* (2013.01); *F25D 31/002* (2013.01); *B67D 2210/00034* (2013.01)
USPC ..... 62/390

(58) Field of Classification Search
CPC ..... B67D 5/56; B67D 5/62; B67D 1/0003; B67D 1/06; B67D 1/0057; B67D 1/0862; B67D 1/0884; B67D 2210/00034; F25D 31/002; F25D 3/04
USPC ..... 62/115, 306, 390, 344; 22/129.1; 222/129.1, 146.6
See application file for complete search history.

(56) References Cited

U.S. PATENT DOCUMENTS 1,627,147 A 5/1927 Clark
1,947,329 A 2/1934 Buttner
(Continued)

FOREIGN PATENT DOCUMENTS

GB 1 300 072 12/1972
GB 2 042 354 9/1980
(Continued)

OTHER PUBLICATIONS

Wunder-Bar Food & Beverage Dispensing Systems, Post-Mix Beverage Dispenser, Automatic Bar Controls, Inc., Rev. 120508.

*Primary Examiner* — Mohammad M Ali
*Assistant Examiner* — Emmanuel Duke
(74) *Attorney, Agent, or Firm* — Jackson Walker, LLP

(57) ABSTRACT

Applicants provide a portable, modular table top system for dispensing chilled carbonated water, chilled non-carbonated water, and ambient (non-chilled) non-carbonated water therefrom. The table top water dispenser includes a cold plate that is chilled by evaporation of a refrigerant, which is part of a cold plate cooling circuit, which includes a compressor and a condenser. A pump and a motor move non-carbonated water through the cold plate to a dispensing valve engaged therewith. The same motor and pump typically drive non-carbonated water through the cold plate, through the carbonator where it becomes carbonated, and through the cold plate again, and out a second dispensing valve. A third dispensing valve is engaged to the remote source of pressurized water and bypasses the cold plate and, also, typically the pump for dispensing from a third dispensing valve.

19 Claims, 7 Drawing Sheets

(51) Int. Cl.

| | |
|---|---|
| ***B67D 1/06*** | (2006.01) |
| ***B67D 1/08*** | (2006.01) |
| ***F25D 31/00*** | (2006.01) |

(56) References Cited

U.S. PATENT DOCUMENTS

| | | | | |
|---|---|---|---|---|
| 2,478,586 | A | 8/1949 | Krapp | |
| 2,682,386 | A | 6/1954 | Lindsay | |
| 2,887,250 | A | 5/1959 | Zilk | |
| 2,937,792 | A | 5/1960 | Firstenberg | |
| 3,009,337 | A * | 11/1961 | Johnson | 62/390 |
| 3,009,653 | A | 11/1961 | Hedeman | |
| 3,013,701 | A | 12/1961 | Joschko | |
| 3,108,779 | A | 10/1963 | Anderson | |
| 3,326,520 | A | 6/1967 | Guenther | |
| 3,619,668 | A | 11/1971 | Pinckaers | |
| 3,643,754 | A | 2/1972 | Brandin et al. | |
| 3,867,962 | A | 2/1975 | Gerrard | |
| 3,963,317 | A | 6/1976 | Eignbrode et al. | |
| 4,098,295 | A | 7/1978 | Haytayan | |
| 4,196,886 | A | 4/1980 | Murray | |
| 4,219,046 | A | 8/1980 | West et al. | |
| 4,390,224 | A | 6/1983 | Showman et al. | |
| 4,433,795 | A | 2/1984 | Maiefski et al. | |
| 4,469,389 | A | 9/1984 | Grabbe et al. | |
| 4,497,421 | A | 2/1985 | Schilling | |
| 4,519,635 | A | 5/1985 | McMath | |
| 4,619,378 | A | 10/1986 | de Man | |
| 4,635,824 | A | 1/1987 | Gaunt et al. | |
| 4,637,527 | A | 1/1987 | Arrigoni | |
| 4,804,112 | A * | 2/1989 | Jeans | 222/129.1 |
| 4,821,921 | A | 4/1989 | Cartwright et al. | |
| 4,921,140 | A | 5/1990 | Belcham | |
| D309,232 | S | 7/1990 | Vallyee et al. | |
| 4,986,449 | A | 1/1991 | Vallyee et al. | |
| 5,033,648 | A | 7/1991 | Nakayama et al. | |
| 5,042,692 | A | 8/1991 | Vallyee et al. | |
| 5,305,924 | A | 4/1994 | Groover et al. | |
| 5,314,091 | A * | 5/1994 | Credle, Jr. | 222/129.1 |
| 5,415,326 | A | 5/1995 | Durham et al. | |
| 5,524,452 | A | 6/1996 | Hassell et al. | |
| 5,649,431 | A | 7/1997 | Schroeder et al. | |
| 5,673,820 | A * | 10/1997 | Green et al. | 222/129.3 |
| 5,722,567 | A * | 3/1998 | Jones et al. | 222/146.6 |
| 5,765,726 | A * | 6/1998 | Jones | 222/129.1 |
| 5,873,259 | A | 2/1999 | Spillman | |
| 6,047,859 | A | 4/2000 | Schroeder et al. | |
| 6,098,842 | A | 8/2000 | Schroeder et al. | |
| 6,112,946 | A | 9/2000 | Bennett et al. | |
| 6,196,422 | B1 | 3/2001 | Tuyls et al. | |
| 6,260,477 | B1 | 7/2001 | Tuyls et al. | |
| 6,269,973 | B1 | 8/2001 | Bennett et al. | |
| 6,283,155 | B1 | 9/2001 | Vu | |
| 6,321,938 | B1 | 11/2001 | Edwards et al. | |
| 6,322,051 | B1 | 11/2001 | Salmela | |
| 6,328,181 | B1 | 12/2001 | Schroeder et al. | |
| 6,345,729 | B1 | 2/2002 | Santy | |
| 6,405,897 | B1 | 6/2002 | Jepson et al. | |
| 6,463,753 | B1 | 10/2002 | Haskayne | |
| 6,560,972 | B2 * | 5/2003 | Ubidia | 62/59 |
| 6,626,005 | B2 | 9/2003 | Schroeder | |
| 6,644,508 | B2 | 11/2003 | Haskayne | |
| 6,672,849 | B1 | 1/2004 | Martindale et al. | |
| 6,698,229 | B2 | 3/2004 | Renken | |
| 6,722,527 | B1 | 4/2004 | Krauss | |
| 6,725,687 | B2 | 4/2004 | McCann et al. | |
| 6,761,036 | B2 | 7/2004 | Teague | |
| 6,832,487 | B1 | 12/2004 | Baker | |
| 6,880,358 | B2 * | 4/2005 | Lucas et al. | 62/344 |
| 6,945,070 | B1 | 9/2005 | Jablonski | |
| 7,021,077 | B2 | 4/2006 | Schroeder | |
| 7,025,230 | B1 | 4/2006 | Salmela | |
| 7,048,148 | B2 | 5/2006 | Roekens | |
| 7,080,937 | B1 | 7/2006 | Salmela et al. | |
| 7,168,593 | B2 | 1/2007 | Schroeder et al. | |
| 7,232,044 | B1 | 6/2007 | Salmela | |
| D549,021 | S | 8/2007 | Tuyls et al. | |
| 7,266,974 | B2 | 9/2007 | Schroeder | |
| 7,305,847 | B2 | 12/2007 | Wolski | |
| 7,337,618 | B2 | 3/2008 | Wolski | |
| 7,337,627 | B2 | 3/2008 | Wolski | |
| 7,373,784 | B2 | 5/2008 | Haskayne | |
| 7,384,073 | B1 | 6/2008 | Tuyls et al. | |
| 7,448,418 | B1 | 11/2008 | Tuyls | |
| 7,757,498 | B2 | 7/2010 | Wolski et al. | |
| 7,762,431 | B1 | 7/2010 | Tuyls et al. | |
| D626,373 | S | 11/2010 | Valiyee et al. | |
| D626,374 | S | 11/2010 | Valiyee et al. | |
| D626,375 | S | 11/2010 | Valiyee et al. | |
| D628,014 | S | 11/2010 | Martindale | |
| 7,931,382 | B2 | 4/2011 | Hecht | |
| D638,659 | S | 5/2011 | Martindale et al. | |
| D643,708 | S | 8/2011 | Hecht | |
| D647,785 | S | 11/2011 | Hecht | |
| D648,420 | S | 11/2011 | Hecht | |
| D648,421 | S | 11/2011 | Hecht | |
| D648,617 | S | 11/2011 | Hecht | |
| D648,826 | S | 11/2011 | Hecht | |
| 2001/0030308 | A1 | 10/2001 | Schroeder | |
| 2002/0005413 | A1 * | 1/2002 | Black et al. | 222/146.6 |
| 2003/0071060 | A1 | 4/2003 | Haskayne | |
| 2003/0121937 | A1 * | 7/2003 | Black et al. | 222/129.1 |
| 2004/0168465 | A1 * | 9/2004 | Renken et al. | 62/390 |
| 2005/0056044 | A1 * | 3/2005 | Allison | 62/390 |
| 2006/0162370 | A1 | 7/2006 | Haskayne | |
| 2007/0056988 | A1 * | 3/2007 | Edwards et al. | 222/129.1 |
| 2008/0135426 | A1 | 6/2008 | Hecht et al. | |
| 2008/0217357 | A1 | 9/2008 | Hecht | |
| 2008/0276641 | A1 * | 11/2008 | Wolski et al. | 62/390 |
| 2009/0078722 | A1 | 3/2009 | Salmela | |
| 2009/0090747 | A1 | 4/2009 | Tuyls et al. | |
| 2009/0145927 | A1 | 6/2009 | Salmela et al. | |
| 2009/0230148 | A1 | 9/2009 | Valiyee et al. | |
| 2010/0097881 | A1 | 4/2010 | Tuyls et al. | |
| 2010/0116842 | A1 | 5/2010 | Hecht et al. | |
| 2010/0147886 | A1 | 6/2010 | Martindale | |
| 2010/0314411 | A1 | 12/2010 | Tuyls et al. | |
| 2011/0057134 | A1 | 3/2011 | Martindale et al. | |
| 2011/0073617 | A1 | 3/2011 | Martindale et al. | |
| 2011/0286883 | A1 | 11/2011 | Hecht et al. | |
| 2011/0315711 | A1 | 12/2011 | Hecht et al. | |

FOREIGN PATENT DOCUMENTS

| | | |
|---|---|---|
| WO | WO 02/090241 | 11/2002 |
| WO | WO 03/024862 | 3/2003 |
| WO | WO 2006/088990 | 8/2006 |
| WO | WO 2009/090429 | 7/2009 |

* cited by examiner

TABLE TOP WATER DISPENSER HAVING A REFRIGERATOR-COOLED COLD PLATE

This patent application claims the benefit of U.S. Provisional Patent Application Ser. No. 61/383,462, filed Sep. 16, 2010.

FIELD OF THE INVENTION

Water dispensers and, more particularly, a self-contained refrigerant circulating table top water dispenser using a refrigerated cold plate.

BACKGROUND OF THE INVENTION

This patent application incorporates herein by reference US Patent Application Publication No. US 2011/0011108, published Jan. 20, 2011, and U.S. Pat. No. 7,296,428, issued Nov. 20, 2007.

Cold plates may be used to chill dispensed beverages. Cold plates act as heat exchangers, providing the chilling of a fluid passing therethrough. Cold plates are known generally in the art of beverage dispensing.

It is known in the art that cold plates may receive a refrigerant, such as Freon or SUVA®L/04A, and acting as an evaporator, absorb heat from a multiplicity of fluid bearing tubes in close proximity to the refrigerant tubes of the cold plate. The fluid bearing tubes may include tubes which engage a dispensing valve for dispensing the fluid into a container and service to a consumer. That is to say, it is known, for example, in U.S. Pat. No. 7,296,428, to use a cold plate as an evaporator (heat exchanger) to absorb heat from a fluid to be dispensed therefrom.

OBJECT OF THE INVENTION

It is an object of the present invention to provide for carbonated and non-carbonated beverages (including chilled and non-chilled beverage) to be dispensed from a self-contained modular, table top dispenser of potable fluids. More particularly, it is an object of the present invention to provide for the dispensing of carbonated and non-carbonated chilled water as well as non-carbonated non-chilled water.

SUMMARY OF THE INVENTION

Applicants provide a portable, modular table top system for dispensing at least chilled carbonated water, chilled non-carbonated water, and ambient (non-chilled) non-carbonated water therefrom. The system is dimensioned to be a table top system, in that its dimensions make it easy enough for one or two people to lift and place on a table or table-like support. The water dispensing system is also designed to be self-contained in that it needs only to engage a source of AC electricity, a source of pressurized $CO_2$, and an external source of pressurized, ambient, non-carbonated water, such as from a city main or municipal water supply. The table top water dispenser includes a cold plate that is chilled by evaporation of a refrigerant, which is part of a cold plate cooling circuit, which includes a compressor and a condenser. A pump and a motor move non-carbonated water through the cold plate to a dispensing valve engaged therewith. The same motor and pump typically drive non-carbonated water through the cold plate, through the carbonator where it becomes carbonated, and through the cold plate again, and out a second dispensing valve. A third dispensing valve is engaged to the remote source of pressurized water and bypasses the cold plate and, also, typically the pump for dispensing from a third dispensing valve.

Applicants provide a system for dispensing multiple potable fluids therefrom, the system comprising a cold plate; a means for cooling the cold plate wherein the means for cooling the cold plate is a refrigerant; a first fluid circuit for carrying ambient water through a pump, through the cold plate, through a carbonator, then back through the cold plate and out a first dispensing valve.

Applicants' first dispensing valve dispenses a chilled carbonated beverage therefrom, where the cold plate is chilled with the use of a refrigerant for substantially evaporating a refrigerant therein.

An embodiment of Applicants' invention has a first fluid circuit carrying water, such as city water from a remote water supply, being received in Applicants' table top, portable water dispensing system.

In a preferred embodiment, Applicants' system is a table top system, that is, capable of being handled by one or two people and compact enough to be set up on a table top, bar top or other vertical support without modification of that support. Therefore, it is typically self-contained and needs only to be plugged into an outside electrical source, an outside source of $CO_2$ and an outside (remote) source of pressurized water (such as city water).

A second fluid circuit may be included in a preferred embodiment of Applicants' present system, which second circuit may carry water or other fluid through the cold plate and then to a second dispensing valve, typically adjacent the first dispensing valve and part of the same modular unit. That is to say, the second fluid circuit would bypass the carbonator and pump, but not the cold plate, and passes through the cold plate at least once before dispensing.

In yet another embodiment of Applicants' present system, a third fluid circuit is provided for carrying water or other pressurized fluid directly to a third dispensing valve; that is, through a third fluid circuit that bypasses the cold plate, carbonator, and, optionally, the pump, and is served from a separate dispensing valve at room temperature.

All of the at least three dispensing valves are typically mounted on a faceplate or front panel that is typically part of the housing of the modular, table top system.

Attached hereto and incorporated herein by reference is a document entitled "Microprocessor-Controlled Multi-Mode Beverage Dispenser," which published patent application illustrates a cold plate cooling circuit, which may be used to cool the cold plate of the fluid dispensing system. The present system, however, typically uses any form of evaporator type cold plate.

Applicants disclose, in one embodiment, a dispenser having an evaporator cold plate, the dispenser includes tubes or fluid lines for engagement to a source of water at ambient temperature; a carbonator; a pump; a housing having a front plate; a first fluid circuit engaging, in order, the source of water, the pump, the cold plate, the carbonator, the cold plate again, and a first dispensing valve located adjacent the faceplate. A second fluid circuit engages the water source, the second fluid circuit carrying fluid to the cold plate, and a second dispensing valve on the front panel. A third fluid circuit engages the water source and a third dispensing valve located on the front panel.

An embodiment of Applicants' beverage dispensing device has a cold plate engaging a refrigeration system. The system engages a remote pressurized water source, a remote source of pressurized $CO_2$ and a remote source of electricity. An embodiment includes a housing having a top wall, a front panel, a rear panel, two side walls, and a bottom wall. A pump having a low end and a high end is provided, the pump for engaging the remote source of pressurized water. A carbonator engages the remote source of pressurized $CO_2$ gas, the carbonator has a fluid input and a fluid output. A first line engages the high end of the pump, the first line also engages the cold plate and is configured for serpentine, heat exchange engagement with the cold plate. The first line leaves the cold plate. A first junction is configured for receiving the first line. The first junction engages a second and a third line. The second line is for carrying fluid from the first line and engaging the cold plate and configured for serpentine, heat exchange engagement therewith. The third line is for carrying fluid from the first line to the fluid input of the carbonator. A fourth line is for engaging the carbonator fluid output, the fourth line then engaging the cold plate, and configured for serpentine, heat exchange engagement therewith. A fifth line is also provided and is adapted to engage the remote pressurized water source. The fifth line bypasses the cold plate. A first dispensing valve is adapted to receive water from a removed end of the second line, for dispensing chilled, non-carbonated water therefrom. A second dispensing valve is adapted to receive carbonated water from a removed end of the fourth line for dispensing chilled, carbonated water therefrom. A third valve is engaged with a removed end of the fifth line for dispensing non-chilled, non-carbonated water therefrom.

BRIEF DESCRIPTION OF THE DRAWINGS

FIG. 5 is a graphical illustration of a top elevational view of an embodiment of the table top water dispensing system of Applicants' present invention.

DETAILED DESCRIPTION OF THE PREFERRED EMBODIMENT

Figure 1:
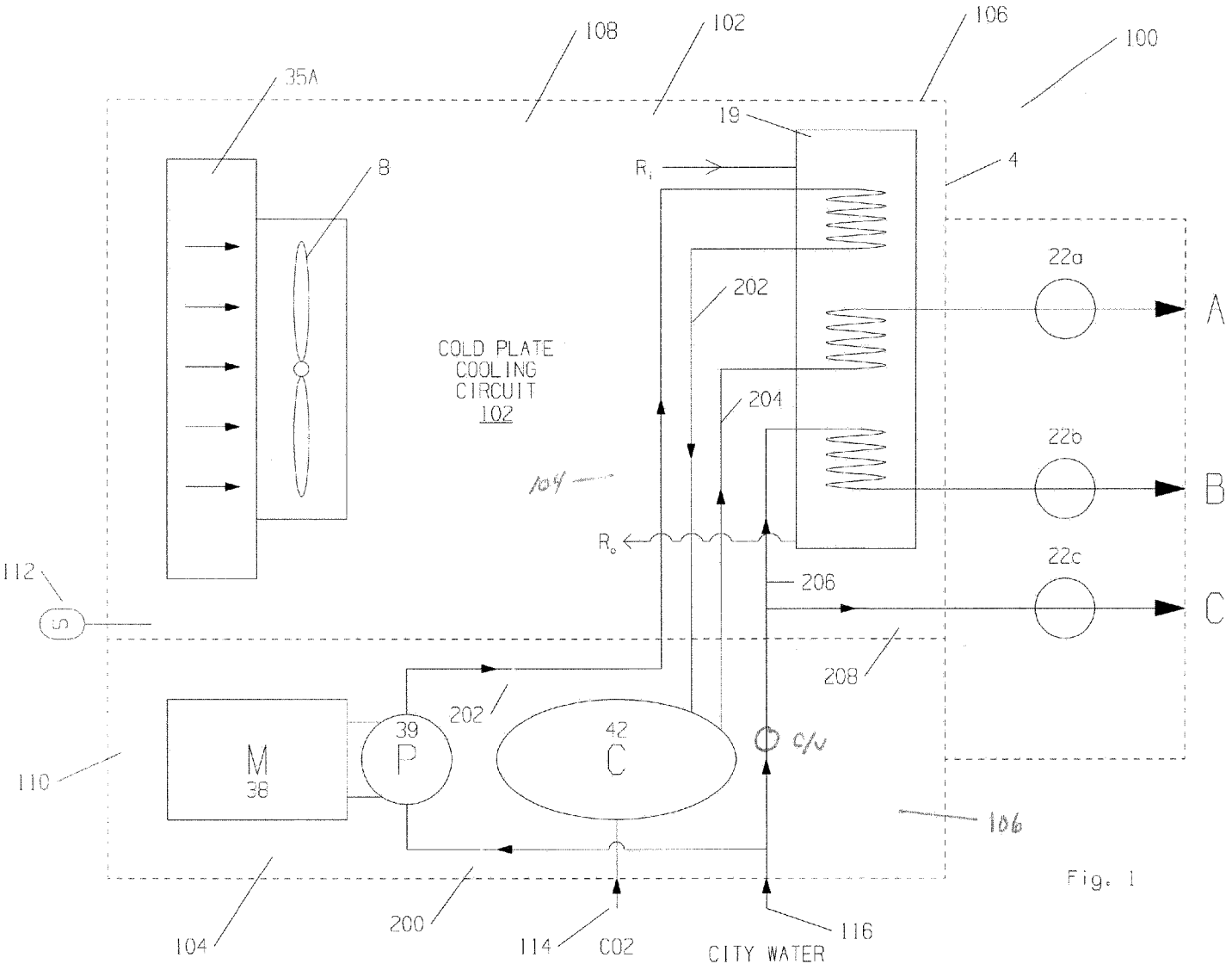
FIG. 1 is a schematic view of the fluid dispensing system of the present invention used in conjunction with a cold plate cooling circuit.
Figure 2:
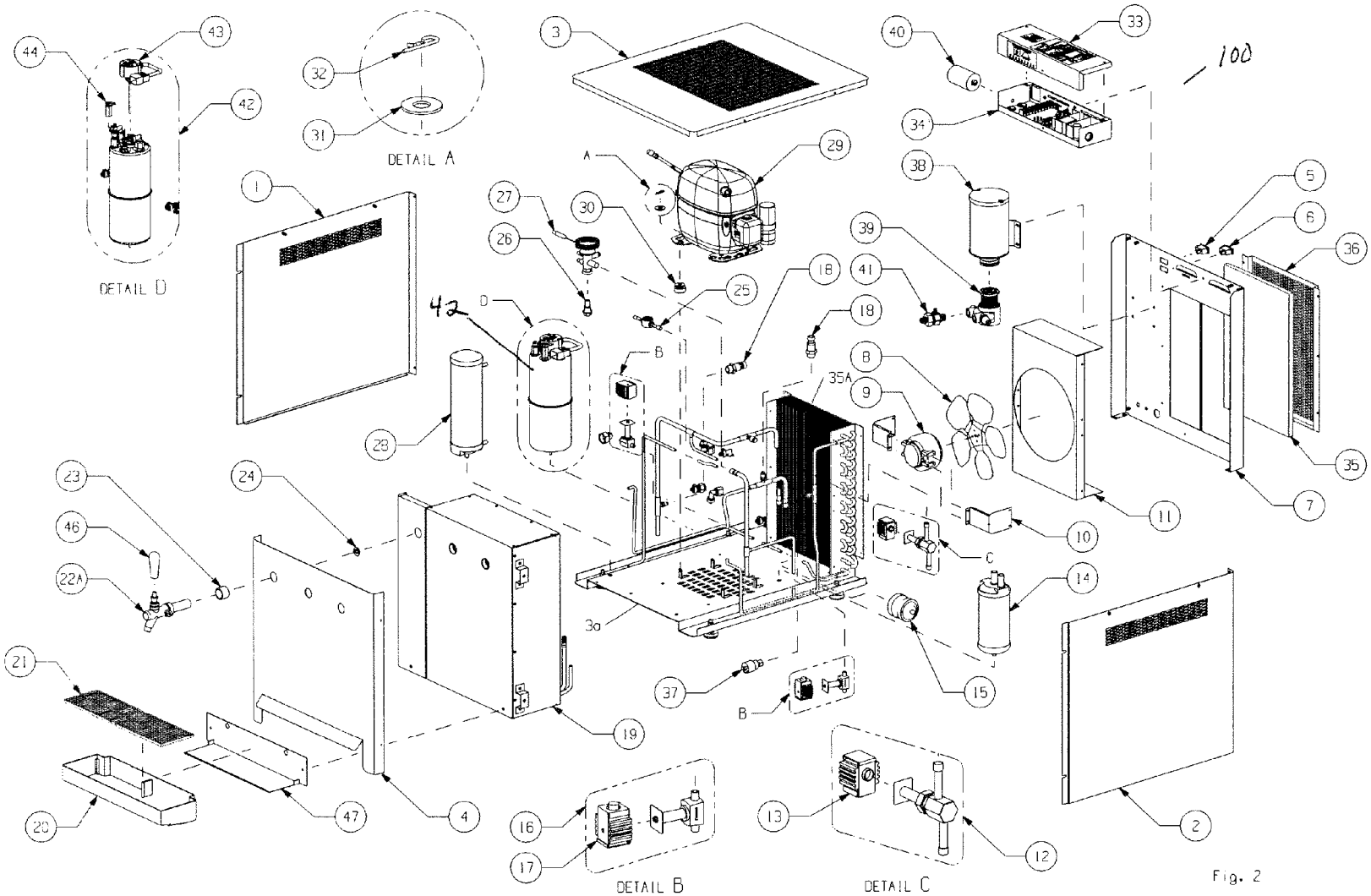
FIG. 2 is an exploded line drawing view illustrating in side perspective, elements of an embodiment of Applicants' table top water dispensing system.
Figure 3:
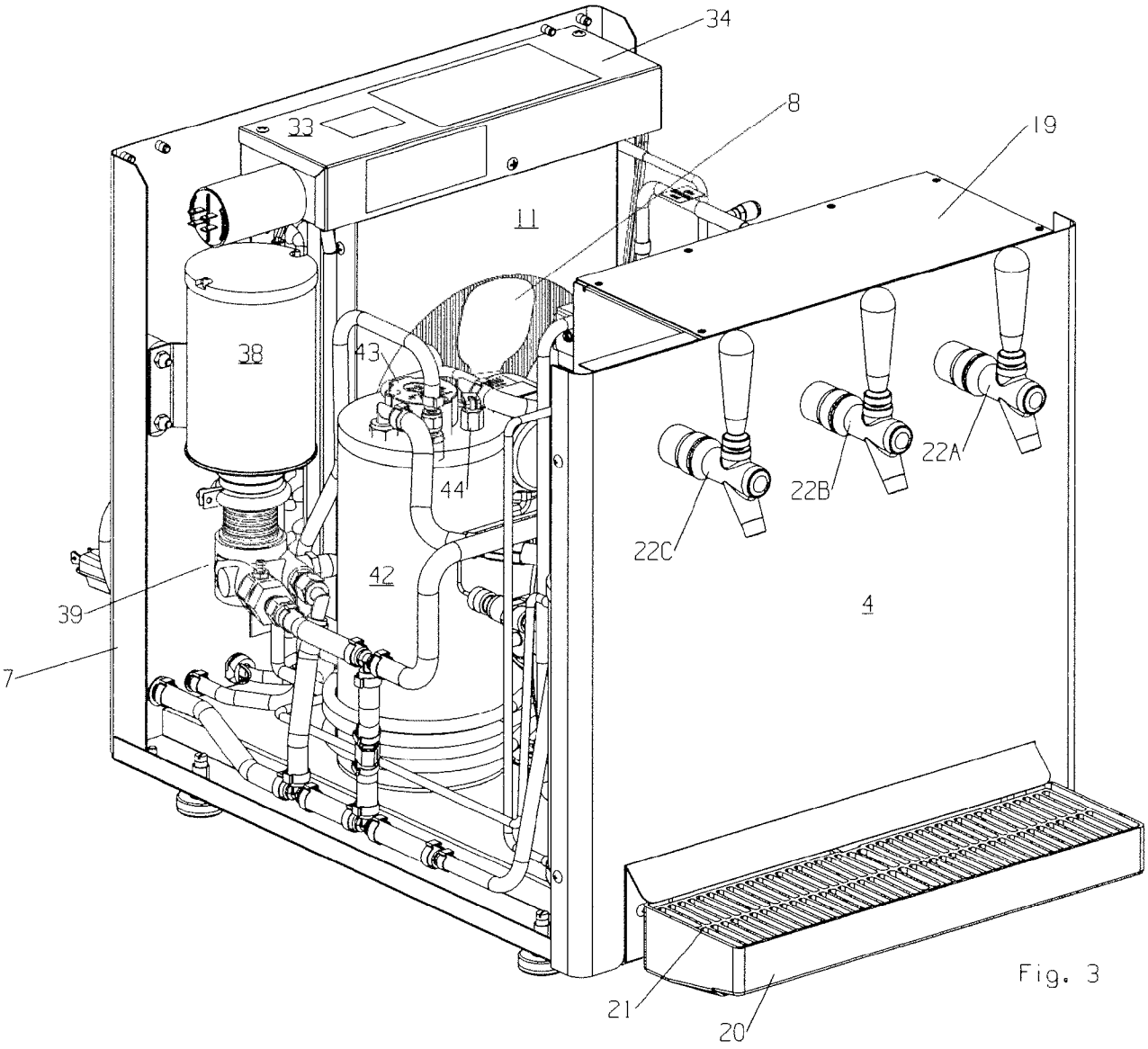
FIG. 3 is a graphical illustration of a front perspective view, from above, of an embodiment of Applicants' table top water dispensing system with the side and top walls removed therefrom.
Figure 4:
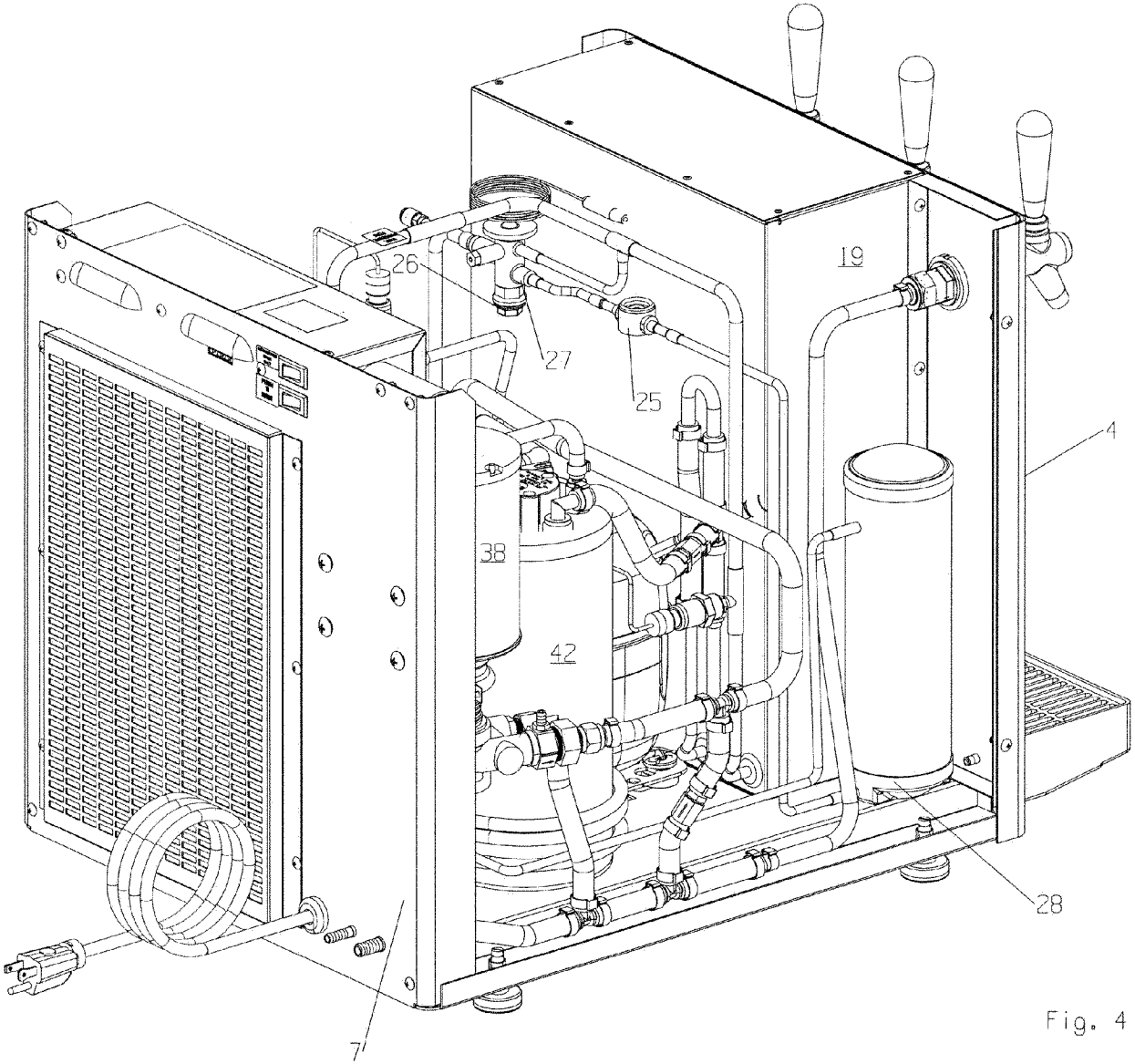
FIG. 4 is a graphical illustration of a rear side elevational view, from above, of an embodiment of Applicants' table top water dispensing system with the side and top walls removed therefrom.
Figure 7:
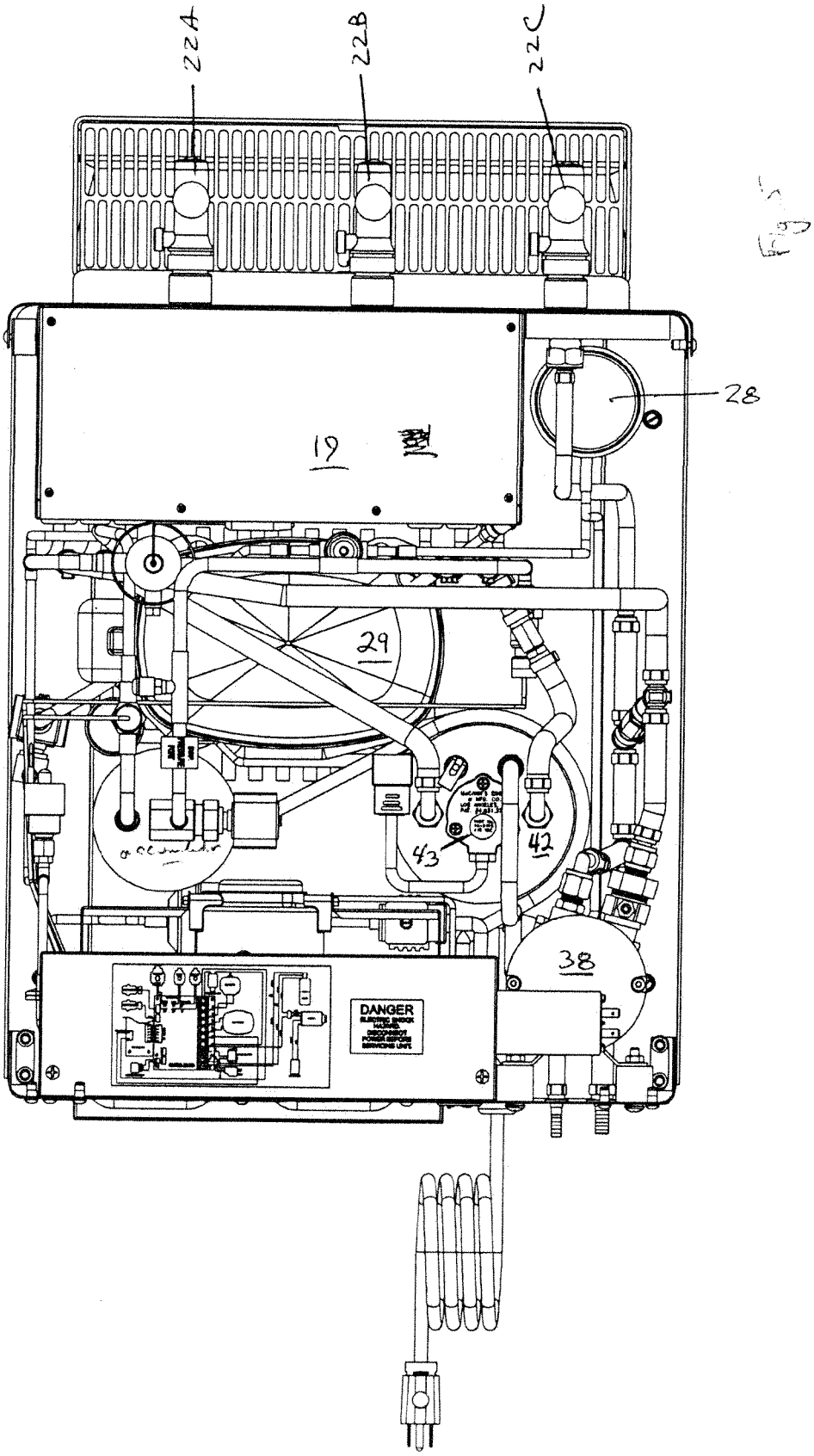

FIGS. 1-5 illustrate various embodiments of Applicants' device. In FIGS. 1-3, it is seen that a table top water (or other potable fluid) dispensing system or device 100 is provided. The device comprises a cold plate cooling circuit 102, such as that described in the '108 publication, as modified herein. The cold plate circuit 102 typically includes a fan 8 as part of a condenser 35A in order to remove heat from the coolant circuit and condense a high pressure gas in ways known in the art. A cold plate assembly 19 is provided (wherein the cold plate acts as an evaporator and heat exchanger) for engagement with the cold plate cooling circuit 102. Ri and Ro indicate refrigerant in and refrigerant out, respectively. Within the cold plate, refrigerant lines are typically serpentine.

The cold plate assembly 19 engages a dispensing circuit 104 comprising multiple fluid circuits. A housing 106 is provided which typically is generally rectangular and includes a top cover 3, bottom wall 3*a*, and four side walls 1/2/4/7, one of which is typically a front plate or front panel 4 as seen in FIG. 2. Front panel 4 is adapted to receive a multiplicity, here at least three, dispensing valves 22A/22B/22C for dispensing fluid as more specifically set forth herein.

While elements 102/104 illustrate the cold plate cooling circuit and a dispensing fluid circuit, respectively, there may also be portions within housing 106 which substantially include within them most of the elements that make up the respective circuits 102/104. That is to say, the interior of housing 106 may include a cold plate cooling circuit area 108 and a dispensing fluid circuit area 110, the two areas within the housing but generally spaced apart from one another, generally adjacent, as seen in FIG. 1.

Applicants' system 100 is substantially self-contained, requiring only engagement with remote AC power 112, an external source of pressurized $CO_2$ 114, and an external pressurized water supply 116, such as city (or municipal) water.

In an embodiment illustrated in FIG. 1, dispensing circuit 104 comprises three fluid circuits. First fluid circuit typically includes a line, here line 200, for carrying city water to a low side of a carbonator pump 39, driven by carbonator motor 38, which may be an electrical motor powered by AC power 112 and controlled, such by an on/off switch 5 (see FIG. 2), or other control means, as known in the art.

First fluid circuit also typically includes a line 202 from the pump high side to the cold plate 19, and from the cold plate 19 to carbonator 42 as illustrated in FIG. 1. The first fluid circuit typically also includes a line 204 from carbonator carrying chilled carbonated water to the cold plate 19 (again) and from cold plate 19 to a first dispensing valve 22A located on the front panel 4 of housing 106. Thus, the first circuit utilizes an evaporator cooled cold plate to pre-chilled non-carbonated water, carbonate the water, and then chill it for a second time as carbonated water for dispensing out valve 22A.

Applicants' device typically includes a second fluid circuit comprising a line 206 carrying water from a pressurized remote ambient source, such as water supply 116, to cold plate 19 and then out to dispensing valve 22B located on front panel 4 of housing 106. Line 206 may or may not bypass the pump, but will engage the cold plate at least once and will bypass the carbonator.

Applicants' dispensing circuit 104 may also comprise a third fluid dispensing circuit, here comprising water supply 116 engaging line 208 for bypassing cold plate 19, carbonator pump 39, and carbonator 42, and for engaging and mounting on front panel 4, a third dispensing valve 22C adjacent and aligned with the aforementioned dispensing valves 22A/22B. Third dispensing valve 22C will dispense ambient, un-carbonated water.

As seen in the illustrations, the three dispensing valves are typically adjacent one another on front panel 4, with the first valve 22A dispensing carbonated water therefrom and driven by a high pressure pump, through a carbonator and having passed twice through cold plate 19 as illustrated. It is seen that the second fluid circuit may utilize the pressure of the remote pressure water supply 116, for example, city water, to drive the fluid a single time through the cold plate for dispensing through second dispensing valve 22B. The third fluid circuit is seen to receive remote pressurized water from remote source 116 and bypass the cold plate. Dispensing valves 22A/22B/22C typically engage front panel as illustrated and set above a drip tray 20, which may include a cup rest 21 thereon.

Figure 1A:
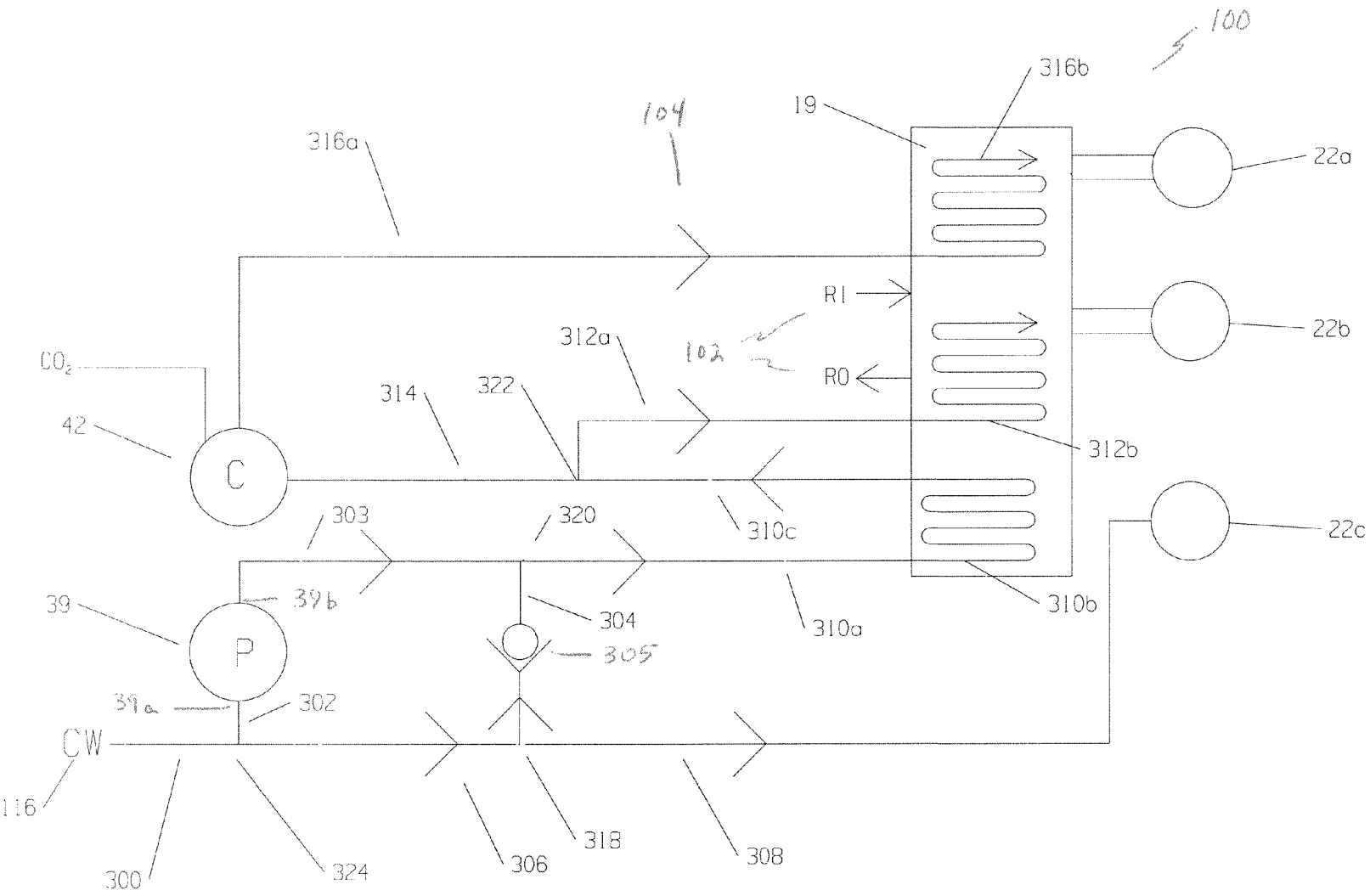
FIG. 1A is a schematic view of a preferred embodiment of a table top water dispensing system.

A preferred embodiment of Applicants' device is illustrated in FIG. 1A, showing chilled, non-carbonated water driven by pump 39 and "twice chilled" before dispensing. A line 300 carries city water to a junction 324, such as a "T" junction. From the junction 324, leg 302 carries water into the low end of pump 39. A line 303 engages the high end of the pump and carries water to junction 320. Going back to junction 324, a second line off the junction is line 306, which carries water to junction 318. From junction 318, water flows through line 304 (which typically has a check valve 305), up to junction 320. Water at junction 320 is coming from line 303 and line 304. Water is output from junction 320 through line 310*a* into the cold plate 19 and through serpentine or coil tubes 310*b*. Coil tubes 310*b* output from the cold plate 19 at line 310*c* into junction 322. Output from junction 322 is one line 312*a*, which goes into cold plate with a multiplicity of passes at coil tubes 312*b*, and is output at cold non-carbonated water dispensing valve 22*b*.

Turning back to junction 322, an output line 314 inputs to carbonator 42. Output of carbonator 42 is designated line 316*a*, which inputs fluid, typically cold soda water, to the cold plate at coil tubes 316*b*. Tubes 316*b* output to dispensing valve 22*a*, and represent "twice chilled" carbonated (soda) water. Line 308 may be ⅜ inch ID going to ¼ inch ID after junction 318 and into dispensing valve 22*c*. This will help maintain water pressure in dispensing valve 22*c* even when pump 39 is running.

Note that cold non-carbonated water dispensed at 22*b*, in the FIG. 1A embodiment, is also "twice chilled." The twice chilling of the non-carbonated water dispensed from 22*b* is from serpentine lines or coil tubes 310*b* and 312*b*. The twice chilling of the carbonated water dispensed from valve 22*a* is from coils 310*b* and 316*b*. Coils are adjacent to and in heat exchange relationship with cold plate 19, which also carries refrigerant.

The elements list below, along with FIGS. 2-5, show the engagement of the cooling circuit 102 and the elements comprising the cooling circuit with the dispensing circuit 104. The elements list set forth below identifies some of the elements and, in some cases, sources for the elements. For example, compressor 29 may be a Danfoss, SC10CL, 115 volt, 60 cycle. It can be seen that the machine ON/OFF switch 5 may be rocker switch, panel mounted, which will turn on the electrical elements of the table top water system 100. Further detail of the control of the cooling system may be found in the '108 publication. A single ON/Off switch 5 provides electrical energy to pump, carbonator, and refrigeration circuit through control panel electrical box assembly 34. the carbonatot and pump are energized by controls known in the art to control the water level in the carbonator by energizing the pump to maintain pressure in the dispensing circuit 104.

Figure 2A:
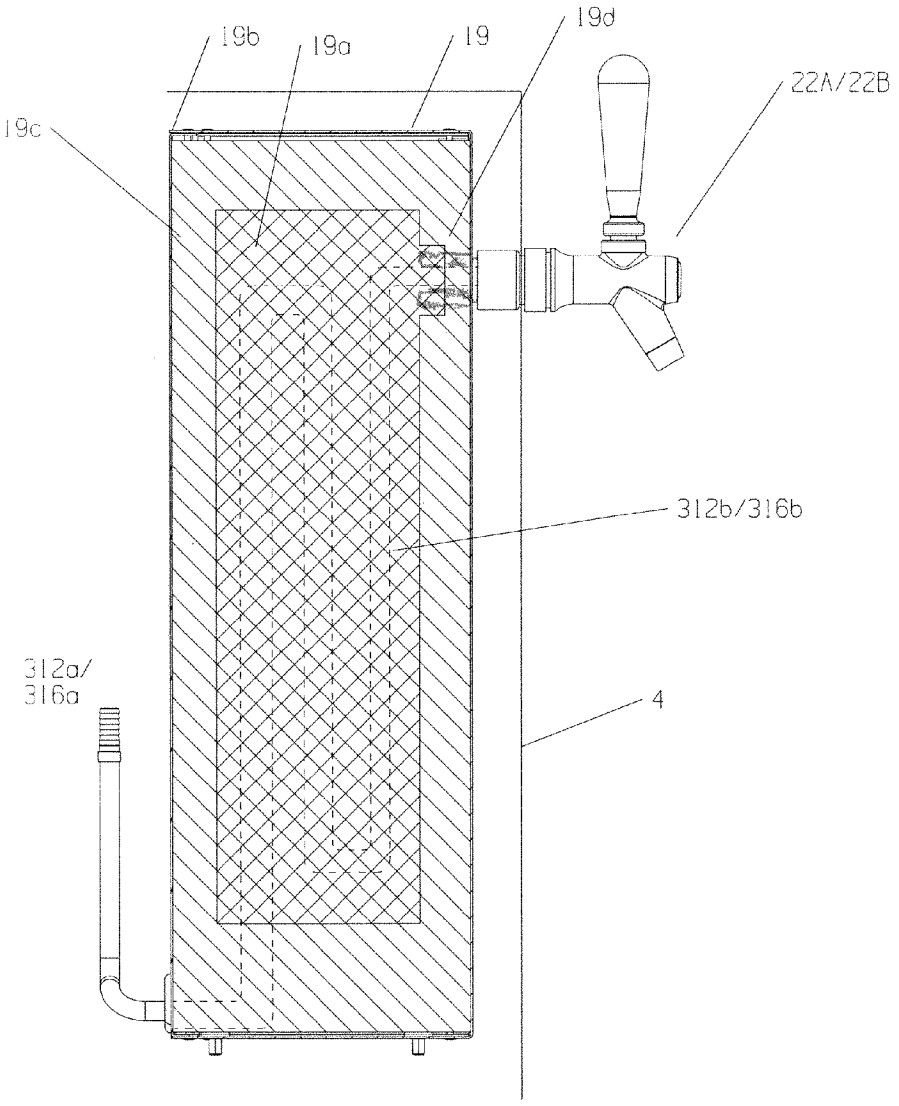
FIG. 2A is a side elevational view, cut away through the cold plate.

Moreover, with reference to FIG. 2A, it is seen that cold plate 19 is typically located vertically adjacent front panel 4 with dispensing valves near the upper portion thereof. FIG. 2A also illustrates the manner in which dispensing valves 22*a*/22*b* directly couple to cold plate 19, typically by a threaded coupling 19*d*. Cold plate 19 may include a cold plate core 19*a*, which is typically centered in a cold plate housing 19*b* typically sheet metal. Insulation 19*c* may be foam, such that the heat exchange core 19*a* of the cold plate is substantially surrounded by the foam inside a shell defined by housing 19*b*. It is seen that lines 312*a*/316*a* engage cold plate 19, enter through the housing, the foam, and into the core 19*a*, which may be cast aluminum. The lines may take the serpentine or coiled path as seen at 312*b*/316*b*. It is in core 19*a* where heat exchange between the cold cast aluminum and the fluid in the coils takes place. The removed ends of 312*b*/316*b* engage threaded coupling 19*d* of core. Threaded coupling 19*d* couples to threads of the removed end of dispensing valves 22*a*/22*b*.

One of the features of Applicants' invention is its ability to be easily handled by one or two people for placement on a table top or other support surface. Many water dispensing systems are big and bulky due, in some cases, to the nature of the cold plate and sometimes due to the nature of the placement of towers or other remote locations for dispensing valves. In a preferred embodiment of Applicants' invention, dispensing valves are directly adjacent and indeed thread into the core of the cold plate itself. That is to say, the nozzle of the water dispensing valves is within two to six inches of the cold plate and just a few inches from the front panel. Moreover, the size of Applicants' housing, that is the six walls that make up the housing, has a length, width, and height that make it a compact, easily transported unit. For example, Applicants' preferred height is about 18.9 inches, width about 18.9 inches, and depth about 22.2 inches. In a preferred range, Applicants' depth is between about 18 to 26 inches, height about 15 to 21 inches, and width about 15 to 21 inches.

1 Left side wall
2 Right side wall
3 Top cover
4 Front panel
5 Machine ON/OFF switch, rocker, panel mounted
6 Defrost switch, momentary DPDT for refrigeration circuit
7 Back panel
8 Fan blade, 9"
9 Fan motor, 14 watt
10 Fan motor bracket
11 Fan shroud
12 Coolant circuit solenoid assembly. E9S230
13 Coolant circuit solenoid coil, 120V. MKC-2
14 Accumulator
15 Drier
16 Coolant circuit solenoid assembly. A3S1
17 Coolant circuit solenoid coil, 120V. MKC-1
18 Coolant circuit pressure switch, 0-150 psi
19 Cold plate assembly, foamed
19*a* Cold plate core
19*b* Cold plate housing
19*c* Insulation
19*d* Threaded coupling
20 Drip tray
21 Cup rest
22 Faucet assembly
22*a*/22*b* Dispensing valves
22A Chilled soda water
22B Chilled water (plain)
22C Ambient water (plain)
23 Faucet sprayer
24 Rubber washer
25 Refrigeration sightglass, ⅜" inline
26 Orifice, Danfoss TU2
27 Expansion valve Danfoss
28 Refrigerant receiver
29 Compressor, Danfoss, SC10CL, 115V 60
30 Compressor mount grommet
31 Washer, Std, 0.406 ID
32 Clip, hitch pin, 0.250 dia.
33 Cover, electrical box
34 Electrical box assembly
35 Condenser filter
35A Condenser
36 Carrier—filter
37 Pressure switch 0-475 psi

38 Carbonator motor
39 Carbonator pump
39*a* Low end, pump
39*b* High end, pump
40 Capacitor—start
41 Back flow preventor (on high side of pump to prevent backflow of $CO_2$ in too high pressure)
42 Carbonator (McCanns, Model 43-1603, Los Angeles, Calif.)
43 Carbonator probe (liquid level in carbonator level switch to turn pump on and off, 115 volt)
44 Pop-off valve
45 Check valve—water (not shown)
46 Handle chrome
47 Bracket drip tray
100 Table top water system
102 Cooling circuit
104 Dispensing fluid circuit
106 Housing (typically six walls)
108 Cold plate cooling circuit portion
110 Dispensing fluid circuit portion
112 AC power
114 Pressurized $CO_2$ source
116 City water or other remote, ambient water supply
200 From city water to pump line (pump low side)
202 From pump high side to cold plate, then carbonator
204 From carbonator thru cold plate to valve 22A
206 From city water through cold plate to valve 22B
208 From city water to valve 22C
300 Line
302 Leg
303 Line
304 Line
305 Check valve
306 Line
308 Line
310*a* Line
310*b*/312*b* Serpentine or coil tubes
312*a*/316*a* Lines
312*b*/316*b* Lines
314 Output line
316*a* Designated line
316*b* Tubes
318/320/322/324 Junctions Although the invention has been described in connection with the preferred embodiment, it is not intended to limit the invention's particular form set forth, but on the contrary, it is intended to cover such alterations, modifications, and equivalences that may be included in the spirit and scope of the invention as defined by the appended claims.

The invention claimed is:

1. A water dispenser for engaging a remote source of pressurized ambient water, a remote source of electricity, and a remote source of CO2 gas, the dispenser comprising:

a refrigeration circuit adapted to engage the remote source of electricity;

a cold plate adapted to engage the refrigeration circuit;

a carbonator for engaging the source of CO2 gas;

a pump for engaging the source of electricity, the pump having a high end and a low end;

a housing defining an interior space, the housing having a vertical front panel, the front panel having an upper portion, the housing including walls for substantially enclosing the elements of dispenser;

a first fluid circuit engaging the remote source of water, the pump, the cold plate a first time, the carbonator, the cold plate a second time, and a first dispensing valve located adjacent the front panel of the housing for dispensing twice chilled carbonated water therefrom;

a second fluid circuit engaging the remote source of water, the second fluid circuit for carrying water and adapted to engage the cold plate a first time, and a second dispensing valve on the front panel to dispense chilled, non-carbonated water therefrom; and a third fluid circuit, the third fluid circuit for engaging the remote source of water, for carrying the water, but bypassing the cold plate, to a third dispensing valve located on the front panel to dispense non-chilled, ambient water therefrom.

2. The water dispenser of claim 1, wherein the first dispensing valve is engaged directly with the cold plate and wherein the second dispensing valve is engaged directly with the cold plate; and wherein the first and second dispensing valves extend outward from the upper portion of the front panel, the two dispensing valves aligned with one another; and wherein the third dispensing valve is not engaged with the cold plate.

3. The water dispenser of claim 2, wherein the housing includes a vertical rear wall and wherein the refrigeration circuit includes a condenser having a vertical axis, and wherein the condenser is placed vertically adjacent the rear wall.

4. The water dispenser of claim 1, wherein the housing is substantially rectangular and has a height of about 18.9 inches, a width of about 18.9 inches, and depth of about 22.2 inches.

5. The water dispenser of claim 1, wherein both the first and second fluid circuits are adapted to engage the high end of the pump.

6. The water dispenser of claim 1, wherein the second fluid circuit is adapted to engage the cold plate a second time, to further chill the non-carbonated water dispensed from the second dispensing valve.

7. The water dispenser of claim 1, wherein the cold plate includes a core, a cold plate housing, and insulation between the core and the housing.

8. The water dispenser of claim 1, wherein the cold plate is placed vertically adjacent an inner surface of the front wall; wherein the first dispensing valve is engaged directly with the cold plate and wherein the second dispensing valve is engaged directly with the cold plate; and wherein the first and second dispensing valves pass through and extend outward from the upper portion of the front panel, the two dispensing valves aligned with one another; and wherein the third dispensing valve is not engaged with the cold plate, and extends outward from the front panel and is aligned with the first and second valves.

9. The water dispenser of claim 8, wherein the housing is substantially rectangular and has a height between about 15 and 24 inches, a width between about 15 and 24 inches, and a depth between about 18 to 28 inches.

10. The water dispenser of claim 8, wherein both the first and second fluid circuits are adapted to engage the high end of the pump.

11. The water dispenser of claim 8, wherein the second fluid circuit is adapted to engage the cold plate a second time, to further chill the non-carbonated water dispensed from the second dispensing valve.

12. The water dispenser of claim 8, wherein the cold plate includes a core, a cold plate housing, and foam insulation.

13. The water dispenser of claim 1, wherein the second and third circuits are without a pump.

14. A water dispenser for engaging a remote source of pressurized ambient water, a remote source of electricity, and a remote source of CO2 gas, the dispenser including:

a refrigeration circuit adapted to engage the remote source of electricity;

a cold plate adapted to engage the refrigeration circuit;

a carbonator for engaging the source of CO2 gas;

a pump for engaging the source of electricity, the pump having a high end and a low end;

a housing defining an interior space, the housing having a vertical front panel, the front panel having an upper portion, the housing including walls for substantially enclosing the elements of dispenser;

a first fluid circuit engaging the remote source of water, the first fluid circuit engaging the pump, the cold plate a first time, the carbonator, the cold plate a second time, and a first dispensing valve located adjacent the front panel of the housing for dispensing twice chilled carbonated water therefrom;

a second fluid circuit engaging the remote source of water, the second fluid circuit for carrying water and adapted to engage the cold plate a first time, and to engage a second dispensing valve on the front panel to dispense chilled, non-carbonated water therefrom; and a third fluid circuit, the third fluid circuit for engaging the remote source of water, for carrying the water and for bypassing the cold plate, and for engaging a third dispensing valve located on the front panel to dispense non-chilled, ambient water therefrom;

wherein the cold plate is placed vertically adjacent an inner surface of the front wall;

wherein the first dispensing valve is engaged directly with the cold plate;

wherein the second dispensing valve is engaged directly with the cold plate; wherein the first and second dispensing valves pass through and extend outward from the upper portion of the front panel, the two dispensing valves aligned with one another;

wherein the third dispensing valve is not engaged with the cold plate, and extends outward from the front panel and is aligned with the first and second valves;

wherein the housing includes a vertical rear wall and wherein the refrigeration circuit includes a condenser having a vertical axis, and wherein the condenser is placed vertically adjacent the rear wall;

wherein the housing is substantially rectangular and has a height between about 15 and 24 inches, a width between about 15 and 24 inches, and a length between about 18 to 28 inches;

wherein both the first and second fluid circuits are adapted to engage the high end of the pump;

wherein the second fluid circuit is adapted to engage the cold plate a second time, to further chill the non-carbonated water dispensed from the second dispensing valve; and wherein the cold plate includes a cold plate housing and foam insulation.

15. A beverage dispensing device for engaging a remote pressurized water source, a remote source of pressurized CO2 and a remote source of electricity, the beverage dispensing device comprising:

a refrigeration system, including at least a compressor and a condenser;

a cold plate adapted to engage the refrigeration system;

a housing having a top wall, a front panel, a rear panel, two side walls, and a bottom wall;

a pump having a low end and a high end, the pump for engaging at the low end the remote source of pressurized water;

a carbonator for engaging the remote source of pressurized CO2 gas, the carbonator with a water input and a water output;

a first line engaging the high end of the pump, the first line engaging the cold plate and configured for serpentine, heat exchange engagement with the cold plate, the first line leaving the cold plate;

a first junction for receiving the first line, the first junction engaging a second and a third line, the second line carrying water from the first line and engaging the cold plate and configured for serpentine, heat exchange engagement therewith, the third line for carrying water from the first line to the water input of the carbonator;

a fourth line for engaging the carbonator water output, the fourth line for engaging the cold plate and configured for serpentine, heat exchange engagement therewith;

a fifth line, the fifth line adapted to engage the remote pressurized water source, the fifth line bypassing the pump, the carbonator, and the cold plate;

a first dispensing valve adapted to receive water from a removed end of the second line, for dispensing chilled, non-carbonated water therefrom;

a second dispensing valve adapted to receive carbonated water from a removed end of the fourth line for dispensing chilled, carbonated water therefrom; and a third dispensing valve adapted to receive water from a removed end of the fifth line for dispensing non-carbonated water at ambient temperature.

16. The beverage dispensing device of claim 15, wherein the first dispensing valve is engaged directly with the cold plate and wherein the second dispensing valve is engaged directly with the cold plate; and wherein the first and second dispensing valves extend outward from the upper portion of the front panel, the two dispensing valves aligned with one another; and wherein the third dispensing valve is not engaged with the cold plate, and extends outward from the front panel and is aligned with the first and second valves.

17. The beverage dispensing device of claim 15, wherein the cold plate includes a core, a cold plate housing, and insulation between the core and the cold plate housing.

18. The beverage dispensing device of claim 15, wherein the housing is substantially rectangular and has a height between about 15 and 24 inches, a width between about 15 and 24 inches, and a depth between about 18 to 28 inches.

19. The beverage dispensing device of claim 15, wherein the first dispensing valve is engaged directly with the cold plate and wherein the second dispensing valve is engaged directly with the cold plate; and wherein the first and second dispensing valves extend outward from the upper portion of the front panel, the two dispensing valves aligned with one another; and wherein the third dispensing valve is not engaged with the cold plate, and extends outward from the front panel and is aligned with the first and second valves; wherein the cold plate includes a core, a cold plate housing, and insulation between the core and the housing; and wherein the housing is substantially rectangular and has a height between about 15 and 24 inches, a width between about 15 and 24 inches, and a depth between about 18 to 28 inches.

* * * * *